US006400093B1

(12) United States Patent
Baumberg et al.

(10) Patent No.: US 6,400,093 B1
(45) Date of Patent: Jun. 4, 2002

(54) FLEXIBLE ELECTRO-LUMINESCENT LIGHT SOURCE WITH ACTIVE PROTECTION FROM MOISTURE

(75) Inventors: Israel Baumberg; Oleg Berezin, both of Maale Adumim; Joseph Dvir, Mevasseret Zion; Boris Gorelik, Beit Shemesh; Alex Kachanovsky; Moshe Voskoboinik, both of Maale Adumim; Michael Zaidman, Jerusalem, all of (IL)

(73) Assignee: ELAM Electroluminescent Industries Ltd., Jerusalem (IL)

( * ) Notice: Subject to any disclaimer, the term of this patent is extended or adjusted under 35 U.S.C. 154(b) by 0 days.

(21) Appl. No.: 09/547,099

(22) Filed: Apr. 11, 2000

(51) Int. Cl.[7] ..... H01J 9/02
(52) U.S. Cl. ..... 315/169.3; 359/44; 445/24
(58) Field of Search ..... 315/169.1–169.4; 313/505, 506, 512; 445/24, 25; 345/42, 60, 211–213; 359/43–45

(56) References Cited

U.S. PATENT DOCUMENTS

| | | | | |
|---|---|---|---|---|
| 4,417,174 A | | 11/1983 | Kamijo et al. | 313/502 |
| 4,455,324 A | | 6/1984 | Kamijo et al. | 427/66 |
| 4,855,189 A | | 8/1989 | Simopoulos et al. | 428/690 |
| 4,902,929 A | | 2/1990 | Toyoda et al. | 313/503 |
| 5,184,969 A | * | 2/1993 | Sharpless | 445/24 |
| 5,220,243 A | | 6/1993 | Klinedinst et al. | 313/502 |
| 5,244,750 A | | 9/1993 | Reilly et al. | 428/690 |
| 5,418,062 A | | 5/1995 | Budd | 428/403 |
| 5,548,420 A | * | 8/1996 | Koshimizu et al. | 359/44 |
| 5,770,920 A | | 6/1998 | Eckersley et al. | 313/506 |
| 5,869,930 A | | 2/1999 | Baumberg et al. | 313/506 |
| 5,959,402 A | | 9/1999 | Polyan | 313/511 |
| 5,976,613 A | | 11/1999 | Janusauskas | 427/66 |
| 6,066,830 A | * | 5/2000 | Cline et al. | 219/121.69 |
| 6,172,659 B1 | * | 1/2001 | Kim | 345/42 |

* cited by examiner

*Primary Examiner*—Don Wong
*Assistant Examiner*—Wilson Lee
(74) *Attorney, Agent, or Firm*—Nath & Associates PLLC; Gary M. Nath; Harold L. Novick

(57) ABSTRACT

A substantially flexible, electro-luminescent light source is presented. The light source comprises an electrodes' assembly, dielectric and electro-luminescent layers, and at least one outer, substantially flexible layer formed of insulating transparent material. The light source is provided with a heating element, and a power supply unit coupled to the electrodes' assembly and to the heating element. The power supply unit selectively operates the electrodes' assembly and the heating element, such as to heat the vicinity of the electrodes' assembly thereby maintaining desired temperature conditions in the vicinity of the light source and thereinside.

30 Claims, 8 Drawing Sheets

FLEXIBLE ELECTRO-LUMINESCENT LIGHT SOURCE WITH ACTIVE PROTECTION FROM MOISTURE

FIELD OF THE INVENTION

The present invention relates to a flexible electro-luminescent light source, which is particularly useful for operation under the conditions of high humidity.

BACKGROUND OF THE INVENTION

Electro-luminescent light sources are widely used due to the fact that they are relatively long-lived, have a low power consumption and emit bright fight. However, they are known to be very sensitive to moisture. The penetration of moisture inside such a light source and its interaction with electro-luminescent layers result in changes in their electro-optical characteristics. In particular, effects, such as the reduction in brightness of their luminescence and an increase in capacitance and current leakage, are observed. All these phenomena reduce the lifetime of the electro-luminescent light source.

Various techniques have been developed aimed at prong electro-luminescent layers in light sources from moisture penetration. The techniques of one kind are based on the micro-capsulation or the powders of electro-luminescent materials. According to this approach, each particle of the electro-luminescent powder is provided with a protective layer, e.g., oxide, that protects the particle from interacting with the molecules of water. Such techniques are disclosed, for example, in the following U.S. Pat. Nos. 5,418,062; 5,244,750; 5,220,243; 4,902,929 and 4,855,189.

Techniques of another kind are associated with the protection of the entire light source from moisture penetration thereinside. For example, light sources sealed in glass or metal/glass housings, can practically be sufficiently protected. However, these light sources cannot be made flexible—they are heavy, and their dimensions and shape are limited by the lousing material. These features significantly restrict the field of applications of such light sources.

For sealing flexible electro-luminescent light sources, various barrier layers have been used, for example, viscose silicone oil or grease that cover the surfaces prior to depositing outer polymer coatings (U.S. Pat. No. 5,869,930), and transparent flexible polymer materials with low permeability for water steams, e.g., various fluoropolymers. The techniques of this kind are disclosed in the following U.S. Pat. Nos. 5,959,402; 5,770,920; 4,455,324 and 4,417,174.

A constructional element made of materials capable of absorbing moisture can also be used for protecting light sources from moisture penetration. This approach is disclosed, for example, in U.S. Pat. Nos. 5,869,930 and 5,959,402.

U.S. Pat. No. 5,976,613 discloses a thick film electro-luminescent film and a method of its manufacture, aimed at solving the moisture problem. According to this technique, a non-hydroscopic binder is used for both phosphor and adjacent dielectric layers, thereby obviating the need for an external protective encapsulation.

All the known methods of protecting flexible electro-luminescent light sources from moisture penetration are passive, and moisture penetrates inside the light source when it is maintained at an atmosphere with a relative humidity of more than 80%. This results in that the electro-optical characteristic of such a light source changes, and correspondingly, its lifetime is significantly reduced. Moisture affects a light source, especially when it is in its inoperative, passive mode (does not emit light), which is the typical case at bright external illumination:

SUMMARY OF THE INVENTION

There is accordingly a need in the art to solve the problem of prolonging the lifetime of electro-luminescent light sources operating under the conditions of high humidity, by providing a novel electro-luminescent light source formed with an electrical heating element.

There is provided, according to a broad aspect of the present invention, a substantially flexible, electro-luminescent light source comprising:

(a) an electrodes' assembly;

(b) dielectric and electro-luminescent layers;

(c) at least one outer, substantially flexible layer formed of insulating transparent material;

(d) a heating element; and (e) a power supply unit coupled to said electrodes' assembly and to said heating element for selectively operating thereof, such as to heat the vicinity of the electrodes' assembly thereby maintaining desired temperature conditions in the vicinity of the light source and thereinside.

The heating element is preferably flexible, based for example on deposited conductive layers or wires. The heating element is accommodated in the light source in such a manner that, when it is switched on, the light source is heated all along its area. The heating of the light source results in that relative humidity of air is reduced in the vicinity of the light source and in pores and cavities thereinside. In other words, the light source becomes located in the dryer air. With the reduction in the relative humidity of air that surrounds the light source and is located thereinside, the probability of interaction between the electro-luminescent material with the water steams reduces. In practice, to achieve the significant effect, heating at a temperature of 4–6° C. is sufficient.

If the heating element does not extend along the entire surface of the emitting layer, which is the typical case for a wire-like heating element, the heating element is accommodated in a flexible, heat conductive layer. This provides the temperature balancing along the entire surface of the light source. For example, a layer of viscous polyetilenglicol mixed with Sodium Lauryl Sulfatic can be used as the heat conductive layer.

The heating element can be an additional conductive layer. The heating element can be made from special wire elements of the construction, or from conductive grids introduced to the light source construction, especially for this purpose. One of the electro-conductive layers typically existing in the construction of a light source, or any other conductive elements of the construction can function as the heating element, provided it is appropriately connected to a power supply unit. More specifically, a transparent electrode, an opaque (rear) electrode, as well lo as a contact to the transparent electrode, can serve as the heating element. Preferably, when the light source is in its passive operational mode, the heating element is necessarily connected to the power supply unit (i.e., is in its operative mode), and may and may not be connected to the power supply unit, when in the active operational mode of the light source. However, the heating element can be continuously connected to the power supply unit, irrespectively of the operational mode of the light source. This is the simplest and the cheapest example. In practice, such a continuous operational mode of the heating element is required at very low voltages and frequencies, when the light source is hardly luminescent. It is clear that with this active mode of the light source, the heat liberation will be negligible, and therefore the heating element should be continuously turned on.

The heating element can be connected to the power supply unit through a switch that actuates and disactuates the current flow through the heating element, depending on the operational mode of the light source. More specifically, when the light source is in its active operational mode, i.e., emits light, the heating element is disconnected from the current source, and when the light source is in its passive operational mode, i.e., does not emit light, the heating element is connected to the current source. This kind of operation is preferable in such cases, when, in the active operational mode of the light source, the conversion of electrical energy into light energy in the light source is followed by heat dissipation sufficient for raising the temperature of the surface of the emitting layer to 5–10° C. higher than the temperature of the surroundings. In this case, heating in the active operational mode of the light source is not needed, and may even be harmful, since it may reduce the lifetime of the light source. The switch actuating and disactuating the current flow through the heating element may comprise a photo-sensitive element. At bright illumination, when an electro-luminescent light source is ineffective, such a switch automatically shifts the light source into the passive operational mode and simultaneously actuates the voltage supply to the heating element, while at weak illumination, automatically shifts the light source into the active operational mode thereof the heating element being thereby disconnected

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1:
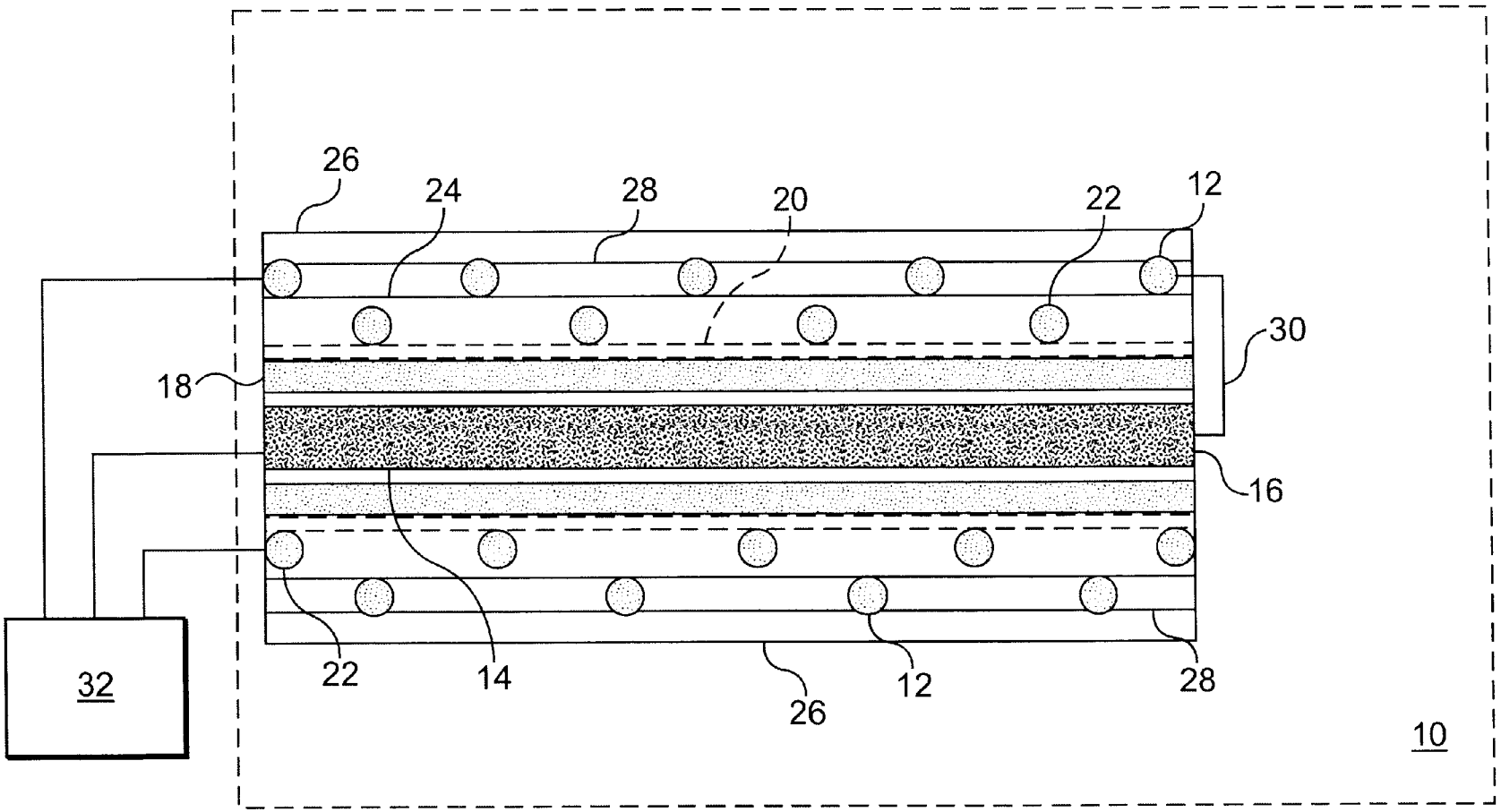
FIG. 1 schematically illustrates a coaxial, flexible, electro-luminescent light source having a wire-like heating element coupled to a power supply through a central electrode.

Referring to FIG. 1, there is illustrated a sectional view of a coaxial electro-luminescent light source, generally designated 10, constructed according to one embodiment of the invention. The light source 10 comprises a wire-like heating element 12 and an electrodes' assembly, which is composed of a central wire electrode 14 (constituting a first electrode) and a transparent electrode 20 (constituting a second electrode) contiguous to a wire contact 22. The central wire electrode 14 is sequentially covered by a dielectric layer 16, an emitting electro-luminophor layer 18, and the transparent electrode 20. Sequentially accommodated above the transparent electrode 20 and the contact 22 are two transparent flexible insulating layers 24 and 26 made of a polymer material, defining a heat conductive layer 28 therebetween, where the wire heating element 12 is located. A connection strap 30 (constituting an additional conductor) connects the wire heating element 12 to the central wire electrode 14 at one side of the light source 10. At the other side of the light source 10 (opposite to the connection strap 30), the wire heating element 12, wire contact 22 and central wire electrode 14 are coupled to a power supply unit 32.

In the present example, the elements of the above construction have the following parameters. The wire electrode 14 is made from a copper wire, of 0.5 mm in diameter. The dielectric layer 16, which may have a thickness in the range of 10–30 $\mu$m, is made from a powder of $BaTiO_3$ in a polymer binder. The electro-luminophor layer 18, which may be 40–70 $\mu$m in thickness, is made from an electro-luminophor powder in a polymer binder. The transparent electrode 20 is manufactured by depositing a TiN oxide layer with a thickness in the range of 0.04–0.1 $\mu$m. The wire contact 22 is a copper tin-plated wire of about 0.07–0.15 mm in diameter wound on the surface of the layer 20 in a spiral-like manner with a pitch of 5–15 mm. The polymer layer 24 is fabricated by means of extrusion deposition of an LDPE layer having the thickness of 0.3–0.4 mm, and the polymer layer 26 is fabricated by means of extrusion deposition of a PVC layer, having the thickness of 0.4–0.5 mm. The heating element 12 is made from a wire of 0.1–0.2 mm in diameter, wound in a spiral-like manner onto the polymer layer 24 inside the layer 28 of viscose polyethylenglycol, mixed with Sodium Lauryl Sulfate with the ratio of 10:1. The connection strap 30 presents a soldering-type electrical connection of the end of the wire electrode 14 (cleaned from all the layers) and the end of the wire heating element 12.

The light source 10 operates in the following manner. When AC-voltage of substantially no less than 40V with a frequency of no less than 50 Hz is applied between the central wire electrode 14 and the wire contact 22 to the transparent electrode 20, the electro-luminescent light source 10 goes into its active operational mode, i.e., emits light. In this case, the electrical circuit of the heating element 12 is disconnected. When the AC-voltage between the central wire electrode 14 and the wire contact 22 is switched off, the electro-luminescent light source 10 stops 20 emitting light, i.e., is shifted into its passive operational mode. In this case, the supply of AC- or DC-voltage to an electrical circuit composed of the heating element 12, connection strap 30 and central wire electrode 14, is automatically actuated, and either a direct or an alternating current flows through this circuit, thereby heating the electro-luminescent light source 10.

Two samples were tested, one being a standard electro-luminescent light source, $ELF_{St}$, which has no heating element, and the other being the electro-luminescent light source ELF 10, constructed as described above (i.e., equipped with the wire heating element 12). Table I shows the comparison results of changes in the electrical parameters of these two samples, while working under 30 humidity of close to 100%. Here, $ELF_{St}$ is the light source, Serial No. 01S 23 BG, commercially available from ELAM Electroluminescent industries Ltd., Israel. The length of each sample is about 50 cm. Both samples were maintained at the active operational mode for 12 hours, and at the passive operational mode for 12 hours. In the active operational mode, the AC-voltage of 100V at the frequency of 400 Hz was supplied to the samples. In the passive mode, the standard electro-luminescent light source $ELF_{St}$ was maintained at a temperature range of 21–23° C. of the surroundings. As for the electro-luminescent light source 10, in the passive mode, the electric current of 120 mA flowed through the heating element 12, which led to the increase of the temperature on the surface of the layer 24 up to 26–28° C.

TABLE I

| | Initial | | 24 days | | 72 days | |
|---|---|---|---|---|---|---|
| | $ELF_{St}$ | ELF 10 | $ELF_{St}$ | ELF 10 | $ELF_{St}$ | ELF 10 |
| Current (mA) | 1.3 | 1.35 | 4.21 | 1.37 | 7.78 | 1.39 |
| Resistance (kOhm) | 450 | 435 | 35 | 432 | 17 | 357 |
| Capacity (nF) | 2.6 | 2.69 | 5.73 | 2.68 | 7.4 | 2.79 |

As clearly shown in Table I, the electrical parameters of the standard electro-luminescent light source $ELF_{St}$ (i.e., without a heating clement) significantly changes already after 24 days of operation with the above-described mode, which leads to a reduction in the brightness of luminescence of the sample. As for the electro-luminescent light source ELF 10 (i.e., with the heating element), the changes of its electrical parameters are negligible.

Figure 2:
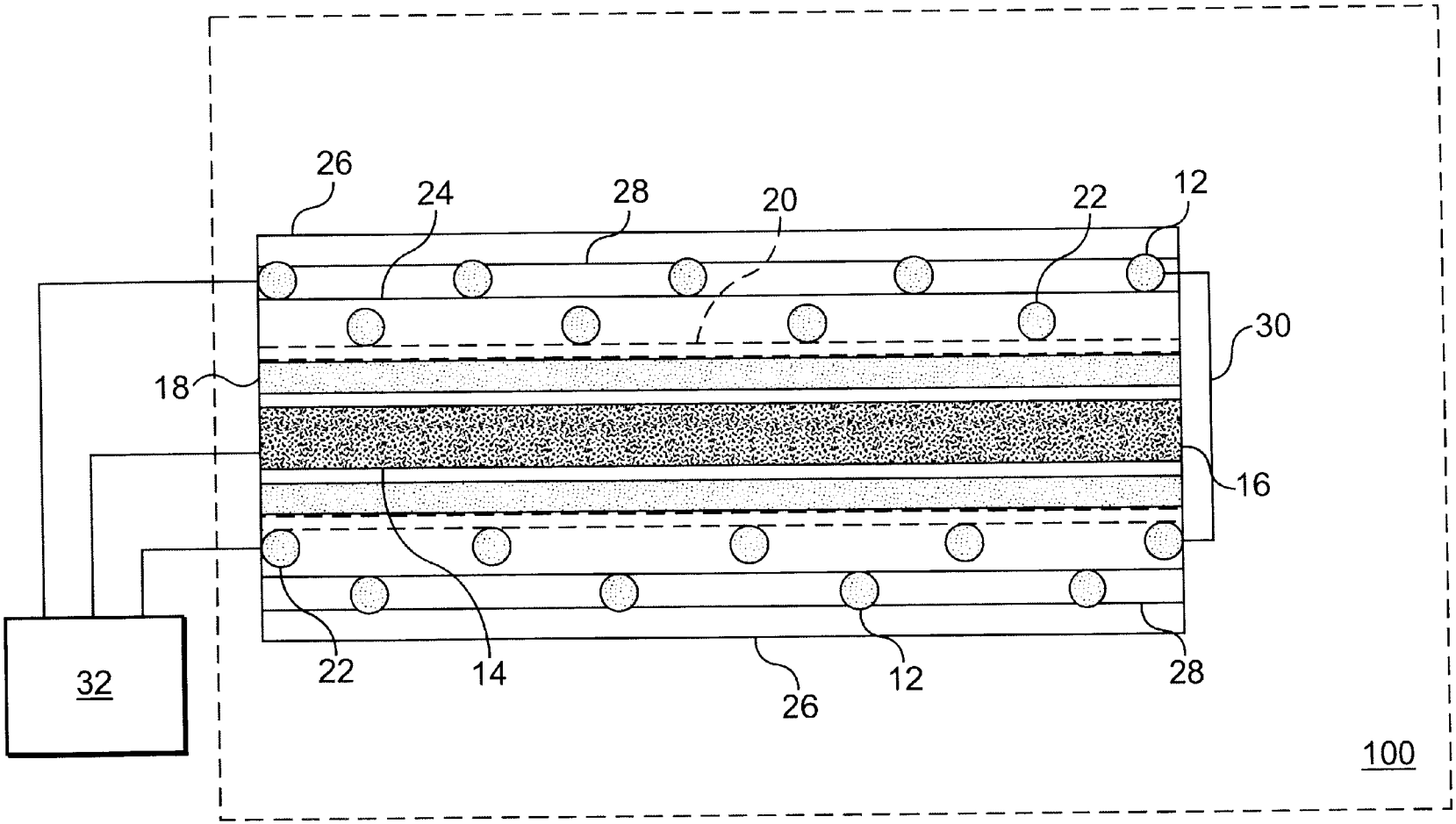
FIG. 2 illustrates a coaxial, flexible, electro-luminescent, light source having a wire-like heating element coupled to a power supply via a wire contact of a transparent electrode.

Reference is now made to FIG. 2, illustrating a sectional view of a coaxial, electro-luminescent light source, generally designated 100, constructed according to another embodiment of the invention. To facilitate understanding, the same reference numbers are used for identifying those components which are identical in the light sources 10 and 100. The light source 100 is constructed generally similar to the light source 10, but is distinguished therefrom in that the connection strap 30 electrically connects the wire heating element to the contact 22, rather than to the central electrode 14 as in the previously described example.

The electro-luminescent light source 100 operates in the following manner. When the power supply unit 32 provides appropriate AC-voltage between the central wire electrode 14 and the wire contact 22 to the transparent electrode 20, the light source 100 emits light. At this stage, the electrical circuit of the heating element 12 is disconnected. When the AC-voltage supply between the central wire electrode 14 and wire contact 22 is switched oft the light source 100 stops emitting light, and the supply of the AC- or DC-voltage to an electrical circuit, composed of the heating element 12, connection strap 30 and wire contact 22, is automatically actuated.

Figure 3A:
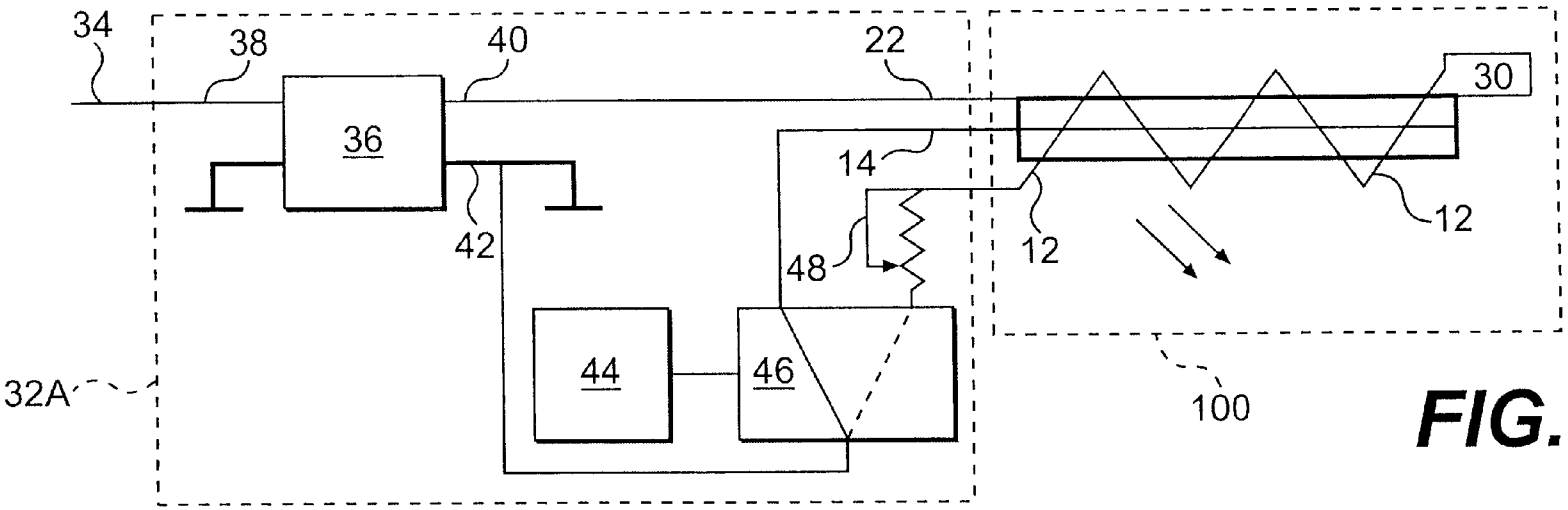
FIGS. 3A and 3B illustrate two examples of a control circuit for opting the electro-luminescent light source of FIG. 2, utilizing, respectively, AC- and DC-voltage supply of the heating element.
Figure 3B:
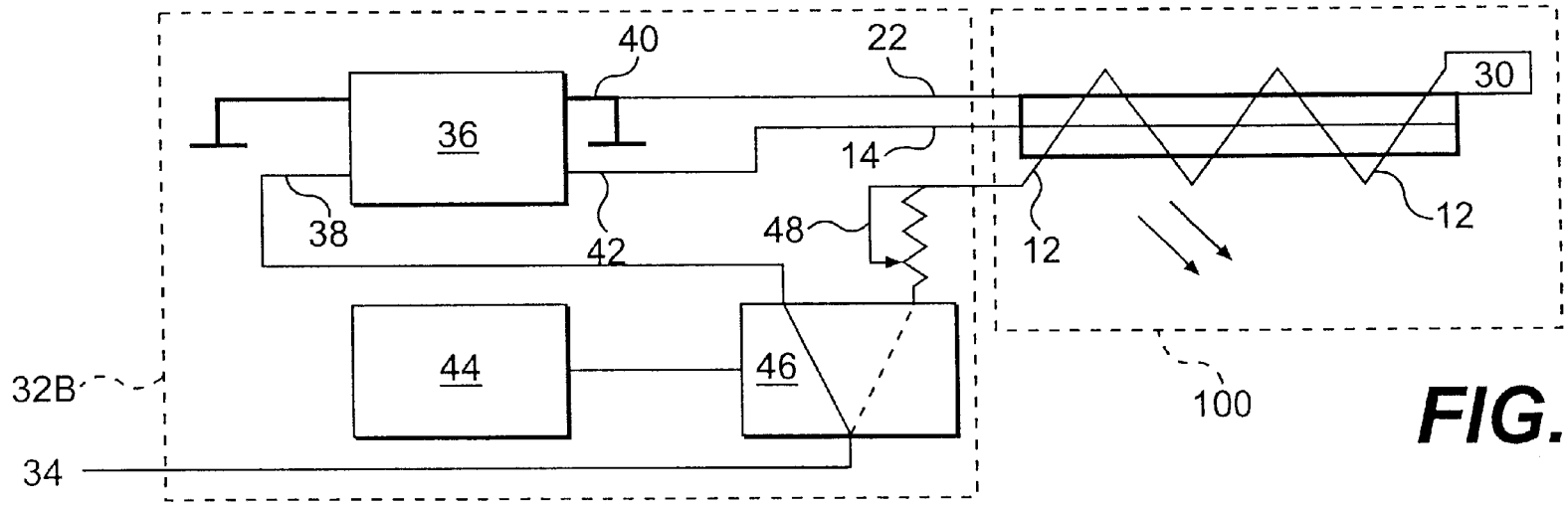

Tuning now to FIGS. 3A and 3B, there are illustrated two different examples of power supply units 32A an 32B, respectively, associated with the electro-luminescent light source 100, shown in FIG. 2. In the example of FIG. 3A, AC-voltage is supplied to the heating element 12, while in the example of FIG. 3B, the heating element 12 is supplied with DC-voltage. Similarly, the same reference numbers are used for identifying those components, which are common in the power supply units 32A and 32B.

Each of the power supply units 32A and 32B comprises a DC-voltage input circuit 34, a DC-to-AC inverter 36 that has its input port 38 and output ports 40 and 42, a switch 44 that switches between the active and passive optional modes of the light source 100, a multiplexer switch 46 and a potentiometer 48. The output 40 of the inverter 36 is connected to the contact 22 of the transparent electrode 20, while the output 42 is connectable either to the central wire electrode 14, or to the wire heating element 12 through the potentiometer 48. This depends on the position of the multiplexer switch 46 set by the switch 44.

The power supply unit 32A (FIG. 3A) operates in the following name DC-voltage is supplied to the input circuit of the inverter 36. If the multiplexer switch 46 connects the output 42 of the inverter 36 to the central electrode 14, the electro-luminescent light source 100 emits light, while there is no current flow through the heating element 12, and thereby no heating effects. If the multiplexer switch 46 connects the output 42 of the inverter 36 to the heating element 12, then an alternating current flows through the heating element 12, wherein the magnitude of the current required to provide heating up to the desired temperature is set by the potentiometer 48. In this case, the central electrode 14 is disconnected from the output 42 of the inverter 36, and the electro-luminescent light source 100 does not emit light.

The switch 44 hat switches between the operational modes of the light source can be of either a manual or automatic operation type. If the automatic switch 44 is used, it may contain a timer, so as to provide the switching in accordance with the given time, or a photosensitive element, which disactuates the luminescence and actuates the heating at bright illumination, and vice versa at weak illumination, i.e., switches on the luminescence and switches off the heating.

The power supply unit 32B (FIG. 3B) operates in the following manner. DC-voltage is supplied to the multiplexer switch 46, which, depending on the position of the switch 44, supplies the voltage either to the input circuit 38 of the inverter 36, or to the heating element 12 though the potentiometer 48. If DC-voltage is supplied to the input circuit 38, the following occurs: the heating element 12 is turned-off (i.e., no heating takes place), while the AC-voltage is supplied from the output ports 40 and 42 of the inverter 36 to the central electrode 14 and to the contact 22 of the transparent electrode 20. Hence, the electro-luminescent light source 100 emits light. If the DC-voltage is supplied to the heating element 12, a direct current flows therethrough (the magnitude of the current being set by the potentiometer 48), and the electro-luminesce light source 100 is heated. This is preformed when the input circuit 38 of the inverter 36 is disconnected, i.e., no AC-voltage is supplied from the output ports 40 and 42 of the inverter 36 to the central electrode 14 and to the contact 22 of the transparent electrode 20, and the light source 100 is in its passive operational mode.

Figure 4:
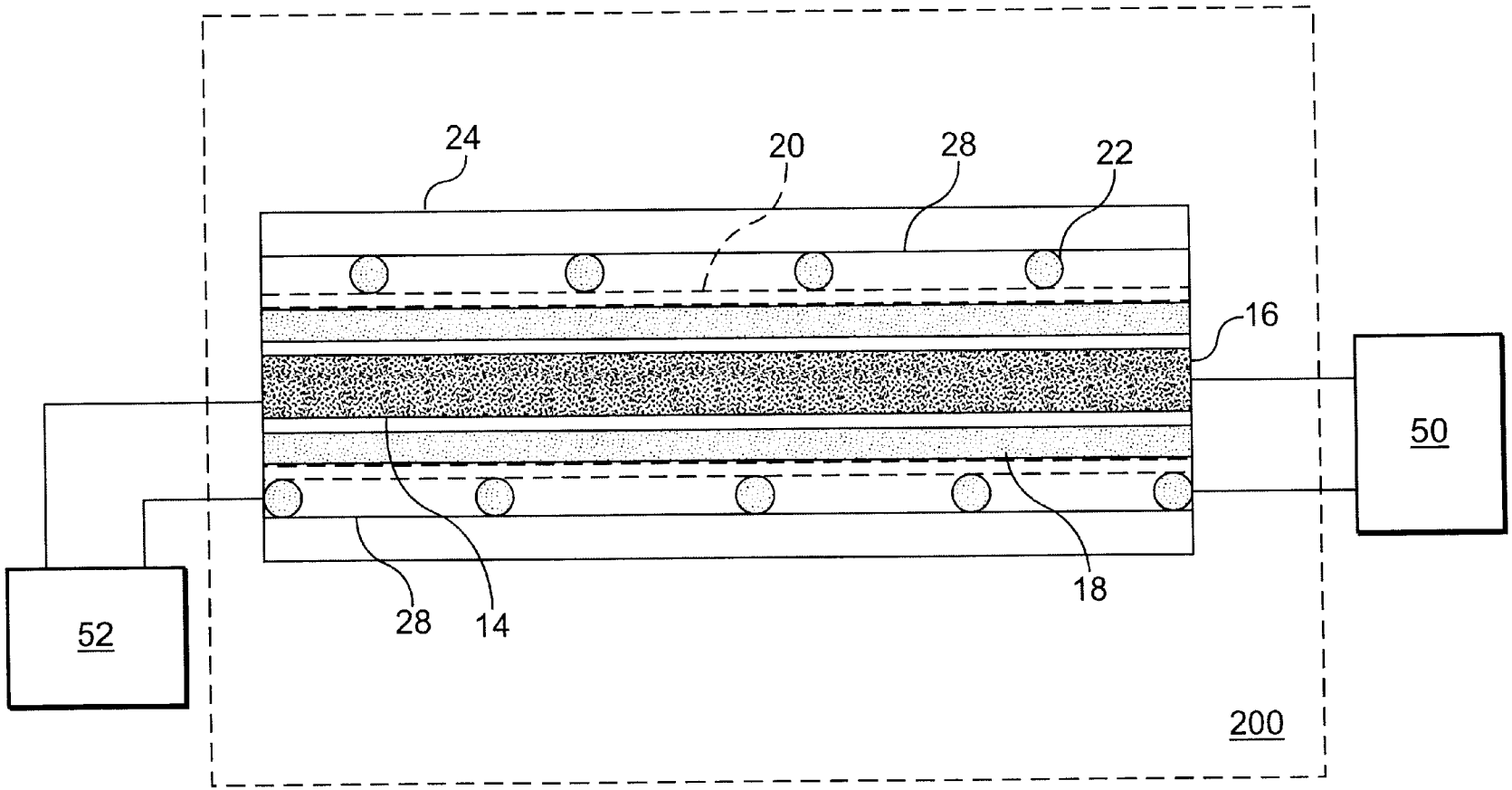
FIG. 4 illustrates a coaxial, flexible, electro-luminescent light source, utilizing a wire contact of a transparent electrode as a heating element.

FIG. 4 illustrates a sectional view of a coaxial, electro-luminescent light source, generally designated 200, according to yet another embodiment of the invention. Here, the wire contact 22 to the transparent electrode 20 serves as a heating element. The central wire electrode 14 is sequentially coated by the dielectric layer 16, emitting electro-luminophor layer 18 and transparent electrode 20. The wire contact 22 is contiguous to the transparent electrode 20, and is accommodated in the heat conductive layer 28. The transparent flexible polymer layer 24 is accommodated above the transparent electrode 20 and the wire contact 22. The central wire electrode 14 and wire contact 22 are coupled to a switch 50, at one end of the electro-luminescent light source 200, and are coupled to a power supply unit 52, at the other end of the light source 200.

When the switch 50 is locked, the wire electrode 14 and wire contact 22 are electrically connected and present together an electrical circuit, to which DC- or AC-voltage is supplied from the power supply unit 52 in such a manner that a current thereby flowing through the circuit heats the wire contact 22. The latter, in such an operational mode, plays the role of a heating element. At this stage, the electro-luminescent fight source 200 does not emit light, i.e., is in its passive mode.

Figure 5A:
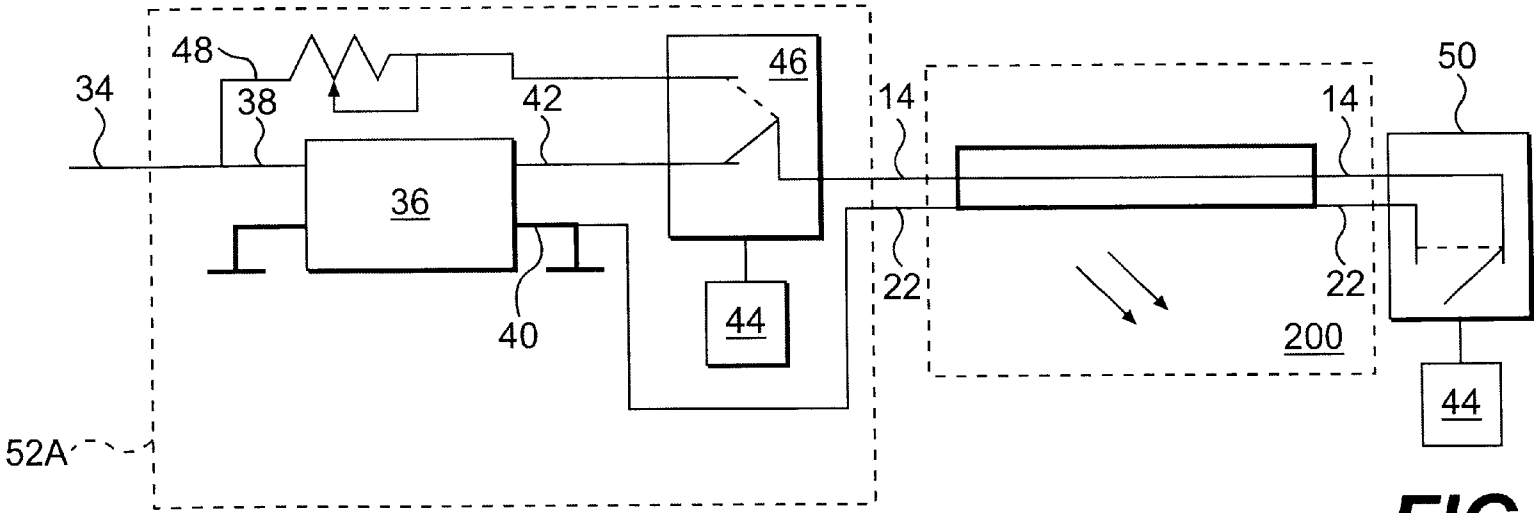
FIGS. 5A and 5B illustrate two examples of a control circuit for operating the electro-luminescent light source of FIG. 4, utilizing a heating element in the form of a wire contact to a transparent electrode, with, respectively, AC- and CD-voltage supply of the heating element.

When the switch 50 is unlocked, the wire electrode 14 and the wire contact 22 to the transparent electrode 20 are electrically disconnected, the wire electrode 14 and transparent electrode 20 thereby become the plates of an electro-luminescent condenser. In this case, corresponding AC-voltage is supplied from the power supply unit 52 to the wire electrode 14 and wire contact 22 of the transparent electrode 20, the electro-luminescent light source 200 being thereby shifted into its active operational mode, i.e., emits light Reference is made to FIGS. 5A and 5B, which show two examples of power supply units 52A and 52B, respectively, coupled to the electro-luminescent light source 200 shown in FIG. 4. In the example of FIG. 5A, a direct current flows through the closed electrical circuit composed of the central wire electrode 14 and wire contact 22 of the transparent electrode 20, while in the example of FIG. 5B, an alternating current flows through this closed electrical circuit. Similarly, the same reference numbers identify those components which are common in the units 52A and 52B, and units 32A and 32B shown in FIGS. 3A and 3B. Thus, each of the power supply units 52A and 52B comprises the DC-voltage input port 34, DC-to-AC inverter 36 (having its input port 38 and output ports 40 and 42), switch 44 composed of two photosensitive switches, multiplexer switch 46 and potentiometer 48.

The power supply unit 52A (FIG. 5A), operates in the following manner. DC-voltage of about 6V is supplied to the input circuit of the inverter 36. AC-voltage of 120V with a frequency of 400 Hz is generated at the output 42 of the inverter 36. The contact 22 to the transparent electrode 20 is connected to the output 40 of the inverter 36. The central wire electrode 14 is connectable to either the DC-voltage input 34 through the potentiometer 48, or to the output 42 of the inverter 36, depending on the position of the multiplexer switch 46. The position of the multiplexer switch 46 and of the switch 50 is set by the photo-sensitive switches 44.

At bright da or artificial lighting, one of the two photosensitive switches 44 locks the switch 50. The other photosensitive switch shifts the multiplexer switch 46 into such a position when it connects the DC-voltage input 34 to the central wire electrode 14. Hence, a direct current flows through the circuit that actuates the potentiometer 48 (which sets the desired magnitude of the current), the multiplexer switch 46, the central wire electrode 14, the closed switch 50 and the contact 22 to the transparent electrode 20. The electro-luminescent light source 200 is thereby heated, while being in its passive operational mode, i.e., not emitting light.

At weak illumination or in darkness, one of the photosensitive switches 44 shifts the multiplexer switch 46 into a position when it connects the central wire electrode 14 to the output 42 of the inverter 36, and the other photosensitive switch disconnects the switch 50, thereby breaking the DC-circuit. This results in that the central wire electrode 14 and the transparent electrode 20 become the plates of a coaxial, electro-luminescent condenser, and the electro-luminescent light source 200 emits light.

Figure 5B:
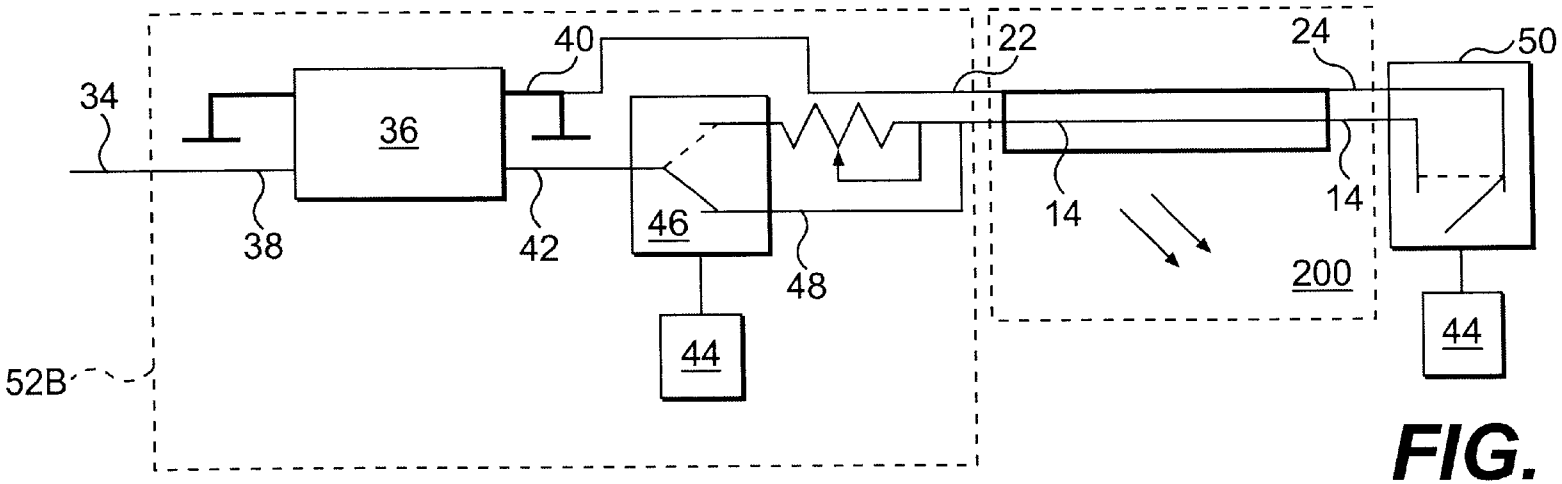

The power supply unit 52B shown in FIG. 5B operates in the following manner. The DC-voltage of 6V is supplied to the input of the inverter 36. An AC-voltage of 120V with a frequency of 400 Hz is generated on the output 42 of the inverter 36. The contact 22 to the transparent electrode 20 is connected to the output 40 of the inverter 36. The central wire electrode 14 is connected to the output 42 of the invert 36, either directly, or through the potentiometer 48, depending on the position of the multiplexer switch 46. When the central wire electrode 14 is connected to the output 42 of the inverter 36 through the potentiometer 48, the switch 50, which, similar to the multiplexer switch 46, is operated by the photosensitive switch 44, is locked. Hence, an alternating current flows through the closed electrical circuit formed by the contact 22, switch 50, central wire electrode 14, potentiometer 48 and multiplexer switch 46. This alternating current heats the electro-luminescent light source 200, while in the passive operational mode thereof. When the multiplexer switch 46 connects the central wire electrode 14 directly to the output 42 of the inverter 36, the switch 50 is disconnected. In this case, the central wire electrode 14 and the transparent electrode 20 become the plates of a coaxial, electro-luminescent condenser, and the electro-luminescent light source 200 emits light.

Figure 6:
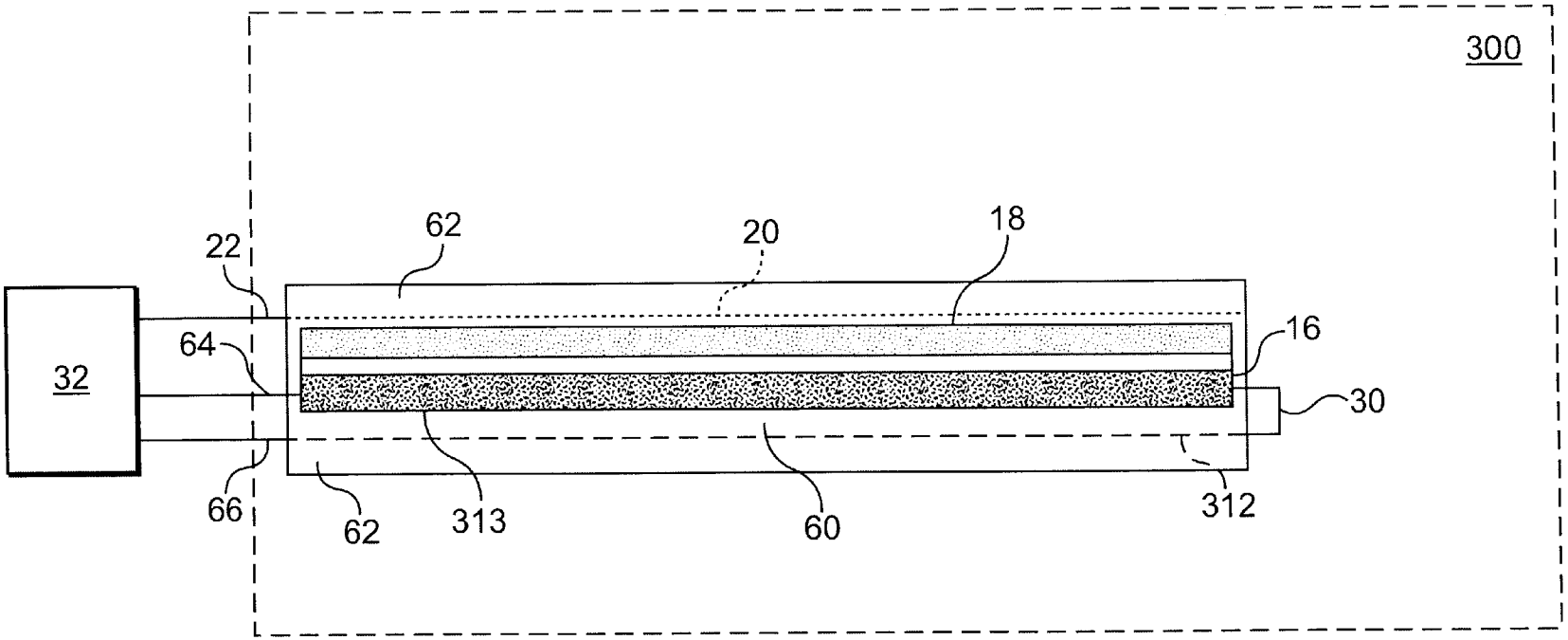
FIG. 6 illustrates a flat flexible, electro-luminescent light source, having a flat heating element accommodated underneath an opaque electrode.

FIG. 6 illustrates a sectional view of a flat, electro-luminescent lamp, generally designated 300, which is provided with a flat heating element 312. A polymer film with a transparent electrode 20 in the form of a clear film sputtered indium-tin oxide (ITO) is covered by an electro-luminophor layer 18 and by a dielectric layer 16 at the ITO-side thereof A rear, opaque electrode 313 is formed on the dielectric layer 16. A dielectric layer 60 separates the rear electrode 313 and the heating element 312 from each other. On its outside, the entire electro-luminescent lamp 300 is sealed by flexible transparent sheets of polymer 62. The connection strap 30 electrically connects the heating element 312 and the rear electrode 313 at one side of the electro-luminescent lamp 300. At the other side of the electro-luminescent lamp 300, the contact 22 to the layer of the transparent electrode 20, a contact 64 to the rear electrode 313, and a contact 66 to the heating element 312 are taken outside the lamp 300, and are coupled to the power supply unit 32.

In the present example, the transparent electrode 20 is a layer of indium-tin oxide (ITO) with the surface resistivity of 200 ohm per square, deposited onto a PET film, having the thickness of 50 $\mu$m. The electro-luminophor layer 18, having a thickness within the range of 40–50 $\mu$m, is based on an electro-luminophor powder mixed in a polymer binder. The dielectric layer 16 with a thickness in the range of 15–20 m is based on a $BaTiO_3$ powder in a polymer binder. The rear electrode 313 is made from a silver-filled ink, which is deposited onto the surface of the dielectric layer 16 as a 10 $\mu$m-thickness layer. The dielectric layer 60 is a PET film of 50 $\mu$m in thickness. Deposited onto the outer side of the PET film 60 is a layer of graphite-filled ink having the thickness of 10 $\mu$m, which is deposited in a meander-like manner with the bands' thickness of 5 mm and a 1 mm-space between the adjacent bands. This graphite-filled ink layer serves as the heating element 312. The flexible, transparent polymer layers 62 are made from moisture-proof laminating film CTFE of 100 μm in thickness. Contacts to the conductive layers are made from bronze-mesh strips. The main technique for assembling the polymer layers is laminating. The connection strap 30 presents the soldering-based connection of contacts to the layers 313 and 312.

The above-described device 300 operates in the following manner. When the electrical circuit of the heating element 312 is disconnected, the power supply unit 32 provides AC-voltage of more than 40 V with the frequency of no less than 50 Hz between the transparent electrode 20 and the rear electrode 313, and the electro-luminescent lamp 300 emits light. When the electrical circuit of the heating element 312 is closed, DC- or AC-voltage is supplied thereto from the power supply unit 32, thereby providing a current of approximately 100 mA. This current flows through the circuit composed of the contact 64, rear electrode 313, connection strap 30, heating element 312 and contact 66. At such an operational mode, the heating element 312 heats the electro-luminescent lamp 300, which does not emit light.

Figure 7:
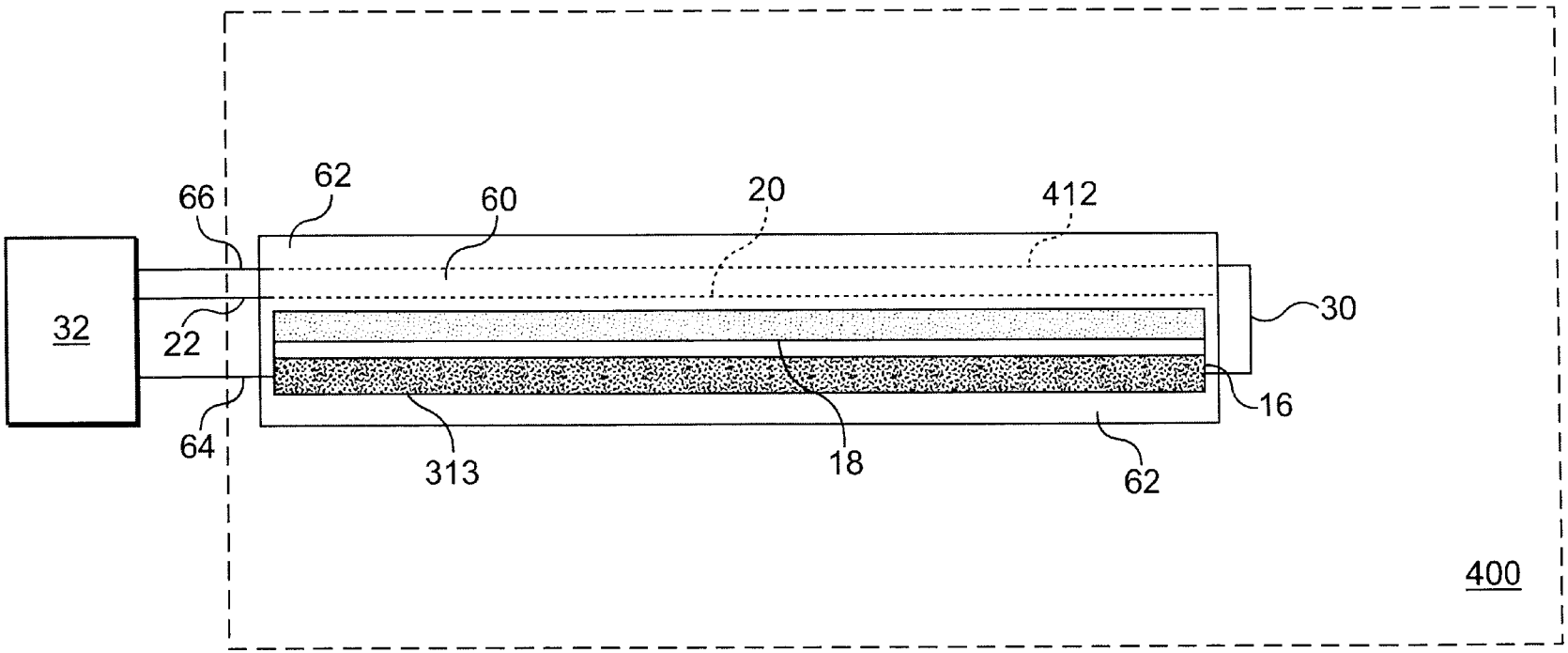
FIG. 7 illustrates a flat, flexible, electro-luminescent light source, having a flat transparent heating element, accommodated above a transparent electrode.

FIG. 7 illustrates a sectional view of an electro-luminescent lamp 400, which is constructed generally similar to that of the example of FIG. 6, but differs in that its heating element 412 is accommodated above the transparent electrode 20, being therefor itself made from a transparent layer of TiN Oxide.

Figure 8:
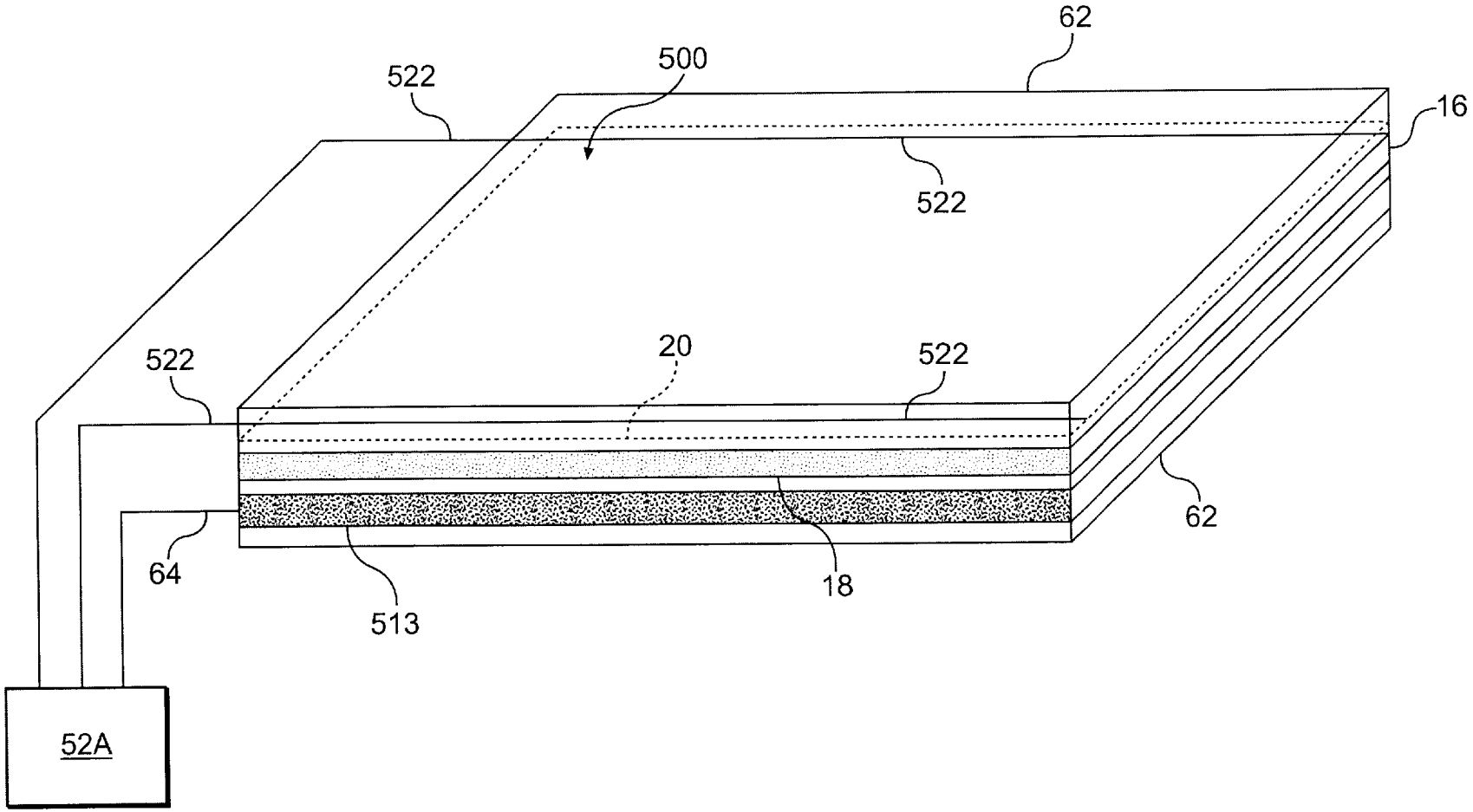
FIG. 8 illustrates a flat flexible, electro-luminescent light source, utilizing a transparent electrode a s a heating element.

FIG. 8 illustrates a sectional view of a flat, electro-luminescent light source 500, in which the transparent electrode 20 plays the role of a heating element. A polymer film with the deposited layer of ITO (clear film sputtered ITO), i.e., the transparent electrode 20, is at its ITO side covered by the electro-luminescent layer 18 and by the dielectric layer 16. Formed on the dielectric layer 16 is a rear opaque electrode 513. The transparent electrode 20 is provided with two contact 522 extending along two opposite sides of the transparent electrode 20. On its outside, the entire electro-luminescent lamp 300 is scaled by flexible, transparent sheets of polymer 62. Both of the contacts 522 to the transparent electrode 20, and the contact 64 to the rear electrode 513, are coupled to the power supply unit 52A (constructed as shown in FIG. 5A). The light source 500 operates in such a manner that in one of the two possible positions of the multiplexer switch 46, AC-voltage of no less than 40V with a frequency of more than 50 Hz is supplied between the electrically connected contacts 522 of the transparent electrode 20 and the contact 64 of the rear electrode 513, the electro-luminescent lamp 500 emitting light. In the other position of the multiplexer switch 46, the contact 64 is disconnected from the inverter 36, the contacts 522 to the transparent electrode 20 are disconnected, and a direct current flows through the electrical circuit including the DC-input 34, potentiometer 48, one of the contacts 522, transparent electrode 20, and the other, grounded contact 22. For the electro-luminescent light source 500 with the dimensions of 5×5 $cm^2$, the current is about 100 mA in the present example, the transparent electrode 20 serves as the heating element. It should, however, be noted that the heating element may be constituted by the rear electrode 513.

Thus, the present invention presents a simple solution for prolonging the lifetime of a substantially flexible, electro-luminescent light source operating under high-humidity conditions. This is achieved by providing the light source with a heating element, which may be implemented in various ways. The heating element may be a separate element accommodated inside the light source, for example a wire-like element. Such a wire heating element may be coupled to a power supply unit either through the central electrode of the light source, or through a wire contact to the other, transparent electrode of the light source. A flat heating element may be provided. In this case, the heating element may be accommodated below so the opaque electrode of the light source, or may be transparent and accommodated above the transparent electrode. The wire contact to the transparent electrode, or the transparent electrode itself may serve as the heating element.

Those skilled in the art will readily appreciate that various modifications and changes can be applied to the preferred embodiments of the invention as hereinbefore exemplified without departing from its scope defined in and by the appended claims.

What is claimed is:

1. A substantially flexible, electro-luminescent light source comprising:

(a) an electrodes' assembly which includes an electrode;

(b) an electro-luminescent layer;

(c) a dielectric layer located between the electro-luminescent layer and said electrode of the electrodes' assembly;

(d) at least one outer, substantially flexible layer of insulating transparent material;

(e) a heating element accommodated with respect to the electrodes' assembly so that, when being operated, said heating element heats the light source all along a surface area of said light source; and (f) a power supply unit coupled to said electrodes' assembly and to said heating element for selectively operating said electrodes' assembly and said heating element, such as to heat the vicinity of the electrodes' assembly thereby maintaining desired temperature conditions in a vicinity of the light source and thereinside.

2. The light source according to claim 1, wherein said electrodes' assembly comprises at least two electrodes spaced from each other by said dielectric and electro-luminescent layers.

3. The light source according to claim 2, wherein at least one of said at least two electrodes is transparent to visual light spectrum.

4. The light source according to claim 1, wherein the active operational mode of the light source is provided when the power supply unit supplies AC-voltage to said electrodes' assembly.

5. The light source according to claim 1, wherein the power supply unit supplies AC-voltage to said heating element, when in the passive operational mode of the light source.

6. The light source according to claim 1, wherein the power supply unit supplies DC-voltage to said heating element, when in the passive operational mode of the light source.

7. The light source according to claim 1, wherein the power supply unit supplies DC-voltage onto the heating element, when in the active and passive operational modes of the light source.

8. The light source according to claim 1, wherein the power supply unit supplies AC-voltage onto the heating element, when in the active and passive operational modes of the light source.

9. The light source according to claim 1, wherein said heating element is formed by at least one of the electrodes.

10. The light source according to claim 9, wherein said at least one of the electrodes periodically serves as the heating element.

11. The light source according to claim 1, wherein said heating element is accommodated in a heat conductive layer.

12. The light source according to claim 11, wherein said heat conductive layer is made of a substantially liquid material.

13. The light source according to claim 11, wherein said heat conductive layer is made of a substantially solid material.

14. The light source according to claim 1, having an elongated shape defining a longitudinal axis wherein said electrodes' assembly comprises a concentric arrangement of a first wire electrode spaced-apart from and parallel to a second electrode, the first, wire electrode being sequentially covered by said dielectric and electro-luminescent layers, and the second electrode being in the form of a transparent conductor located above the layers covering the first electrode, the first electrode extending inside the light source along said longitudinal axis thereof;

the second, transparent electrode is formed with a wire contact located thereon for supplying voltage thereto;

at least two flexible dielectric layers are deposited onto the second electrode with the wire contact;

the heating element is formed by at least one wire located between said flexible dielectric layers; and said first electrode, said wire contact, and the wire heating element are coupled to the power supply unit.

15. The light source according to claim 14, wherein said at least two flexible dielectric layers are made of a polymer material.

16. The light source according to claim 14, wherein the wire heating element is by its one end directly coupled to the power supply unit, and by its other end is coupled to the power supply unit through the first electrode.

17. The light source according to claim 14, wherein the wire heating element is by its one end directly coupled to the power supply unit, and by its other end is coupled to the power supply unit through the wire contact of the second electrode.

18. The light source according to claim 14, wherein the wire heating element is by its one end directly coupled to the power supply unit, and by its other end is coupled to the power supply unit through an additional conductor.

19. The light source according to claim 14, wherein said at least one wire of the heating element extends parallel to the fit electrode.

20. The light source according to claim 14, wherein said at least one wire of the heating element is accommodated in a cylindrical-spiral manner.

21. The light source according to claim 1, wherein said electrodes' assembly comprises a first, wire electrode covered by said dielectric and electro-luminescent layers, and a second electrode made of a transparent conductor located above the layers covering the first electrode, the first electrode being centrally accommodated inside the light source along a longitudinal axis of said light source;

the second, transparent electrode is formed with a wire contact located thereon for supplying voltage thereto;

a flexible dielectric layer is deposited onto the second electrode with the wire contact;

the heating element is said wire contact of the second electrode, the wire contact and the first electrode being coupled to the power supply unit.

22. The light source according to claim 21, wherein said flexible dielectric layer is made of a polymer material.

23. The light source according to claim 21, wherein the wire contact of the second electrode is by its one end directly coupled to the power supply unit, and by its other end is coupled to the power supply unit through an electronic switch and the first electrode, the electronic switch disconnecting electrical connection between the wire contact and the first electrode in the active operational mode of the light source, and providing said electrical connection in the passive operational of the light source.

24. The light source according to claim 1, wherein said power supply unit comprises a switch that switches between the active and passive operational modes of the light source.

25. The light source according to claim 24, wherein said switch that switches between the active and passive operational modes of the light source is photo-sensitive, and automatically switches the light source into its active operational mode at weak external illumination, and switches the light source into its passive operational mode at strong external illumination.

26. The light source according to claim 1, which is a substantially flat structure of a plurality of sequentially accommodated layers, wherein said electrodes' assembly comprises first and second electrodes, either one of the first and second electrodes being transparent;

the plurality of layers includes a substantially flexible transparent polymer layer with the first electrodes deposited thereon, the electro-luminescent layer, the dielectric layer, the second electrode, and additional, substantially flexible, polymer dielectric layer;

the structure has outer back and front water-proof flexible polymer layers, at least one of said water-proof flexible polymer layers being transparent;

the heating element is carried by at least one of said substantially flexible polymer layers, such that the heating element has no contact with the first and second electrodes, the first and second electrodes and the heating element being coupled to the power supply unit.

27. The light source according to claim 24, wherein the heating element is formed of a transparent conductor.

28. The light source according to claim 1, which is a substantially flat structure of a plurality of sequentially accommodated layers, wherein:

the plurality of layers includes a substantially flexible transparent polymer layer with one of the electrodes deposited thereon and provided with two contacts located at opposite ends of the polymer layer, the electro-luminescent layer, the dielectric layer, the other electrode, and additional substantially flexible polymer dielectric layer, one of the electrodes being transparent;

the light source is in its active operational mode, when the power supply unit supplies AC-voltage to the electrodes, and when in the passive operational mode of the light source, the power supply unit supplies voltage through outputs of one of the electrodes, the heating element being in the form of said one of the electrodes.

29. The light source according to claim 2, wherein said at least two electrodes present a concentric arrangement of spaced-apart parallel first and second electrodes, the heating element being by its one end directly coupled to the power supply unit, and by its other end being coupled to the power supply unit through the first electrode.

30. The light source according to claim 1, wherein said electrodes' assembly comprises a concentric arrangement of spaced-apart parallel first and second electrodes, the heating element being by its one end directly coupled to the power supply unit, and by its other end being coupled to the power supply unit through a wire contact of the second electrode.

* * * * *

UNITED STATES PATENT AND TRADEMARK OFFICE

CERTIFICATE OF CORRECTION

PATENT NO. : 6,400,093 B1
DATED : June 4, 2002
INVENTOR(S) : Israel Baumberg et al.

It is certified that error appears in the above-identified patent and that said Letters Patent is hereby corrected as shown below:

Column 11,
Line 45, after “the” and before “electrode”, please replace “fit” with -- first --.

Signed and Sealed this

Twenty-fourth Day of September, 2002

*Attest:*

*Attesting Officer*

JAMES E. ROGAN
*Director of the United States Patent and Trademark Office*